US006418768B2

(12) United States Patent
Meisser et al.

(10) Patent No.: US 6,418,768 B2
(45) **Date of Patent: *Jul. 16, 2002**

(54) METHOD AND APPARATUS FOR PRODUCING A CRIMP CONNECTION

(75) Inventors: Claudio Meisser, Cham; Tony Egli, Hochdorf; Hilmar Ehlert, Luzern, all of (CH)

(73) Assignee: Komax Holding AG, Dierikon (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/093,277

(22) Filed: Jun. 8, 1998

(30) Foreign Application Priority Data

Jun. 12, 1997 (EP) ..... 97810371

(51) Int. Cl.[7] ..... B21C 51/00; B21D 55/00

(52) U.S. Cl. ..... 72/20.1; 72/14.8; 72/20.2; 72/31.11; 72/441; 72/712; 29/753

(58) Field of Search ..... 72/20.1, 20.2, 72/20.3, 20.4, 21.1, 21.3, 441, 442, 446, 21.4, 21.5, 712, 14.8, 31.11; 29/705, 753, 863

(56) References Cited

U.S. PATENT DOCUMENTS 5,152,162 A * 10/1992 Ferraro et al. ..... 72/21.5
5,253,572 A * 10/1993 Uehara et al. ..... 72/21.4
5,522,244 A 6/1996 Ergenmann et al.
5,587,633 A * 12/1996 Aoki et al. ..... 72/20.1
5,669,257 A * 9/1997 Inoue et al. ..... 72/20.1
5,887,469 A * 3/1999 Maeda et al. ..... 72/20.1
5,909,913 A * 6/1999 Fitz, Jr. et al. ..... 72/712
5,913,934 A * 6/1999 Inoue et al. ..... 72/446
5,921,125 A * 7/1999 Inoue et al. ..... 72/20.2
5,966,806 A * 10/1999 Maeda et al. ..... 29/863

FOREIGN PATENT DOCUMENTS

| | | |
|---|---|---|
| DE | 195 48 533 | 7/1996 |
| EP | 404 350 | 12/1990 |
| EP | 597 212 | 5/1994 |

* cited by examiner

*Primary Examiner*—Ed Tolan
(74) *Attorney, Agent, or Firm*—Cohen, Pontani, Lieberman & Pavane

(57) ABSTRACT

A crimping including a stand at which a motor and a transmission are arranged. Moreover, first guides, at which a crimping bar is guided, are arranged at the stand. A shaft driven by the transmission has an eccentric pin at one end, and a resolver for detection of rotational angle is coupled to the other end. The crimping bar includes of a slide member guided in the first guides and of a tool holder with a retaining fork. The slide member stands in loose connection with the eccentric pin, wherein the rotational movement of the eccentric pin is converted into a linear movement of the slide member. The tool holder actuates a tool, which together with an anvil produces the crimp connection. An operator terminal is provided as an interface between the operator and the crimping press. The operator terminal includes a rotary knob and a keypad for input of operating data and commands into a control. A display is provided for visualization of data.

11 Claims, 6 Drawing Sheets

METHOD AND APPARATUS FOR PRODUCING A CRIMP CONNECTION

BACKGROUND OF THE INVENTION

1. Field of the Invention

The invention relates to a method of and apparatus for controlling a crimping process which serves for connecting a contact with a conductor and in which a crimping tool of a crimping press is driven from a start position into a crimping position and subsequently into an end position.

2. Discussion of the Prior Art

Contacts are fixed to conductors, which have been previously stripped of insulation, by means of a crimping press, wherein at the same time a crush or press connection—also called crimp connection—is produced between the contact and the conductor insulation and a crush or press connection is produced between the contact and the electrically conductive conductor wire. The crimping press essentially consists of a stand, at which a drive for a crimping tool is arranged, and a crimping bar, which is guided and driven at the stand and which actuates the exchangeable tool for production of the crimp connection. The linear movement, which is necessary for the crimping process, of the tool is derived from, for example, a rotational movement which is generated by means of a motor, a transmission and a shaft, which is driven by the transmission, with an eccentric pin. Also known are crimping presses in which the linear movement is generated directly by means of hydraulic and/or pneumatic linear drives.

The sizes and shape of the contacts can vary widely according to the respective use, which makes different tools necessary. Also, the crimp zones of the contacts are differently formed. In the case of processing of a contact with an open crimp zone, the stripped conductor is brought about 5 to 10 millimeters over the contact and exactly positioned in the axial direction relative to the contact by means of a sensor. Upon lowering of the tool with the two crimping dies—a first crimping die for the insulation crimp and second crimping die for the wire crimp—the conductor is held by means of a mechanical device and lowered, in company, by the tool movement, wherein a crimp connection is produced between the contact and the conductor insulation and a crimp connection is produced between the contact and the electrically conductive conductor wire. The processing of a contact with a closed crimp zone is more costly, because the stripped conductor has to be guided into a tubular opening of the crimp zone. The tube of the contact is aligned, by appropriate centering, during an intermediate stop of the tool, which facilitates the pushing of the conductor wire into the tube. The processing of contacts with a closed crimp zone is more time-intensive by comparison with the processing of contacts with an open crimp zone.

The crimp connection arises between the movable first or second crimping die for the insulation crimp or for the wire crimp and a correspondingly constructed, fixedly arranged anvil. During the crimping process, the tool together with the dies is driven towards the anvil through a specific dimension. Moreover, the contact is similarly advanced through a contact indexing by means of the die movement by way of a mechanical system.

Crimping presses with a tool stroke of 30 millimeters or 40 millimeters are the general standard in conductor processing. The crimping presses predominantly operate on the eccentric principle, wherein the linear movement of the die is produced by means of the eccentric pin arranged on the driven shaft. The rotating eccentric pin stands in loose connection with the crimping bar and moves the crimping bar linearly. The rotational movement can also be converted into the linear movement by means of a connecting rod. Eccentric crimping presses work rapidly and are economic in manufacture.

However, the fixed stroke preset by the eccentric pin is disadvantageous in these crimping presses. For tools with different stroke lengths, a mechanical action has to be undertaken at the crimping press, in that the dead centers of the eccentric pin are displaced or the shaft with the eccentric pin is exchanged. A subsequent adjustment is necessary in each case.

SUMMARY OF THE INVENTION

Accordingly, it is an object of the present invention to provide a crimping press, in which the tool stroke is settable, for the production of crimp connections while avoiding the disadvantages of the known equipment.

Pursuant to this object, and others which will become apparent hereafter, one aspect of the present invention resides in a method for controlling a crimping process for connecting a contact with a conductor, which method comprises the steps of driving a crimping tool of a crimping press from a start position into a crimping position and subsequently into an end position, and selecting the start and end positions of the crimping tool for processing different contacts.

In another embodiment of the inventive method the crimping tool is moved between the start position and the end position by a rotational movement in which the start and end are at different locations.

In still another embodiment of the inventive method the crimping tool, in a succeeding crimping process, is moved in a direction of rotation that is opposite to a direction of rotation of a preceding crimping process.

In still a further embodiment of the inventive method the respective position of the crimping tool is detected and used for controlling the crimping. Furthermore, the method includes selecting any single one of a crimping process for checking the crimping connection, a crimping process with an intermediate stop for positioning the conductor, and a crimping process with a preselected stroke.

Another aspect of the invention resides in an apparatus for producing a crimping connection, which apparatus includes a motor-driven crimping tool and means for selectively controlling position and movement of the crimping tool.

In another embodiment of the apparatus the crimping tool includes a drive motor while the control means includes a computer operatively connected to the drive motor so as to control the drive motor according to selectable prescribing data and in dependence on a respective position of the crimping tool.

In still another embodiment of the inventive apparatus the control means includes a transmitter operatively arranged to detect the respective position of the crimping tool. The control means can further include an inverter operatively connected between the computer and the drive motor so as to control the drive motor in accordance with the specification data from the computer.

In yet a further embodiment of the crimping apparatus pursuant to the invention, an operator terminal is provided which is in operative communication with the control means. The operator terminal includes a keyboard or keypad and a display for input and visualization of user and system data. Furthermore, a rotary knob is provided at the operator terminal for selecting the start and end position of the crimping tool.

The advantages achieved by the invention are essentially to be seen in that in the processing of different contacts no re-equipping of the crimping press is necessary and that also small contacts are able to be processed. It is further of advantage that no sensors for monitoring the start position or intermediate position of the tool with the dies are needed. With the crimping press according to the invention the number of crimping processes per unit time can be substantially increased without change in the mechanical system. Moreover, the control of the crimping press recognizes the exact tool position at any time, whereby a simple evaluation of the crimping forces is made possible and other machines participating in the crimping process can be synchronized.

The various features of novelty which characterise the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
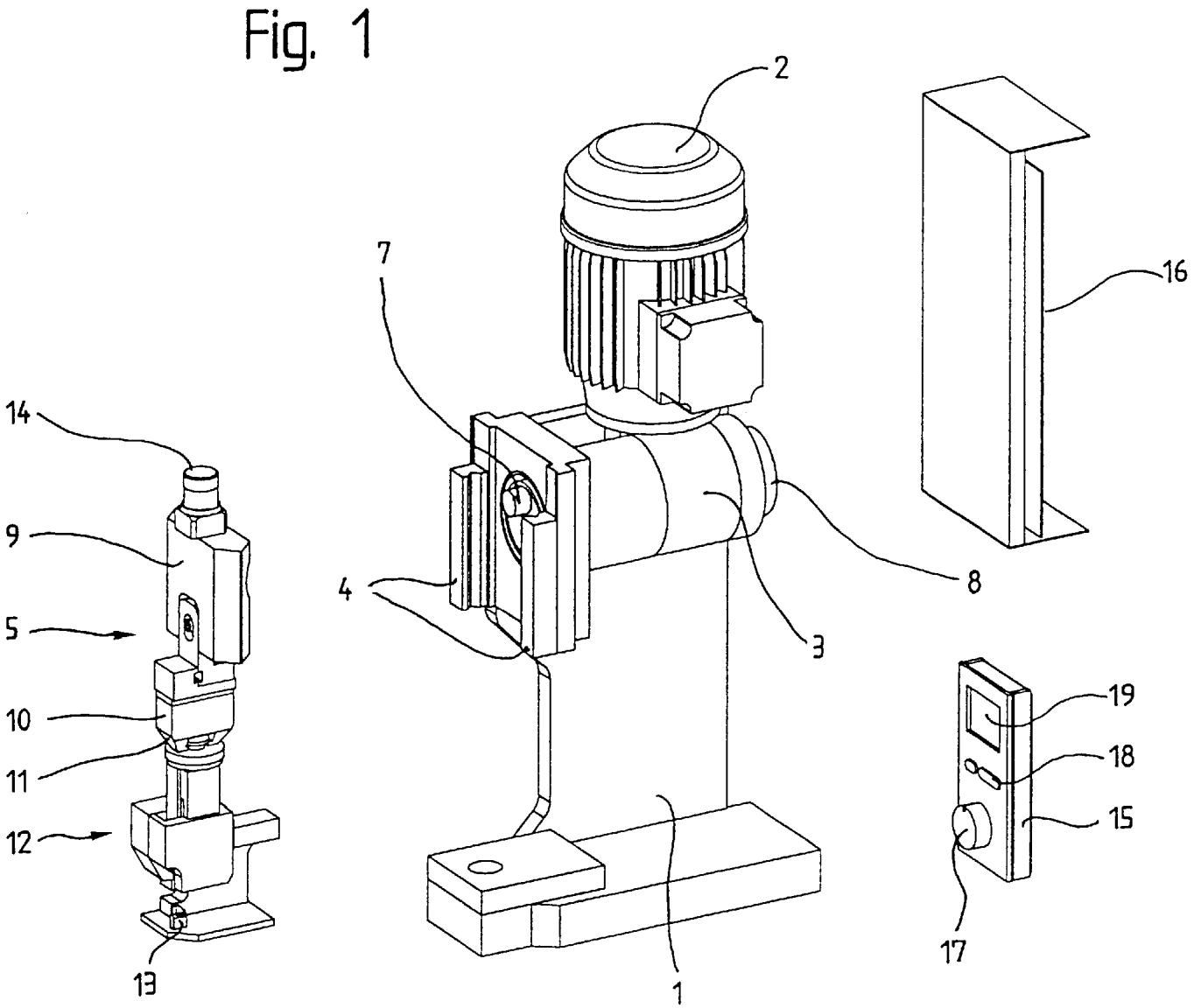
FIG. 1 shows a crimping press with a tool for production of a crimp connection.

A stand 1 without a right-hand side wall, is shown in FIGS. 1–16. A motor 2 and a transmission 3 are mounted at the stand 1. Moreover, first guides 4, are provided at the stand 1 and a crimping bar is guided in the first guides 4. A shaft 6 driven by the transmission 3 has an eccentric pin 7 at one end, and a resolver 37 for detection of the rotational angle is coupled to the other end. The crimping bar 5 consists of a slide member 9 guided in the first guides 4 and a tool holder 10 with a retaining fork 11. The slide member 9 stands in loose connection with the eccentric pin 7, wherein the rotational movement of the eccentric pin 7 is converted into a linear movement of the slide member 9. The maximum stroke of the slide member 9 is determined by the upper dead center and the lower dead center positions of the eccentric pin 7. The tool holder 10 actuates a tool 12, which, together with an anvil 13 belonging to the tool 12, produces the crimp connection. The stroke can be precisely adjusted by means of an adjusting screw 14. An operator terminal 15 is provided as an interface between an operator and the crimping press. The operator terminal 15 comprises a rotary knob 17 and a key pad 18 for the input of operating data and commands into a control 16 and a display 19 is provided for visualisation of data.

Figure 3:
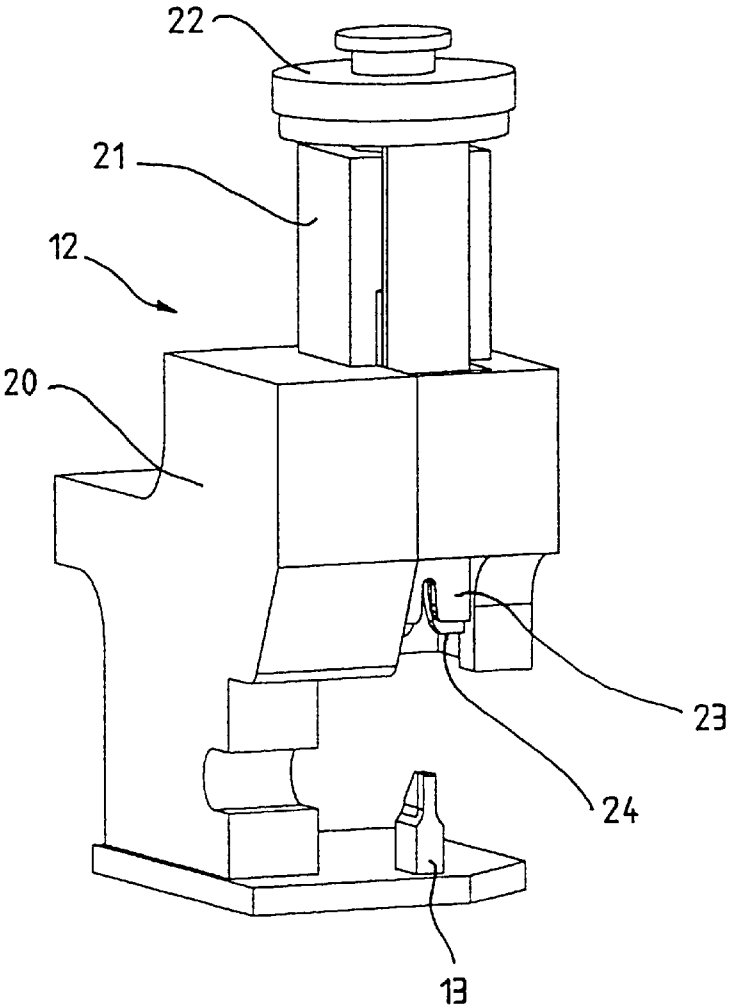
FIG. 3 shows the tool with crimping dies in the upper dead center position.
Figure 2:
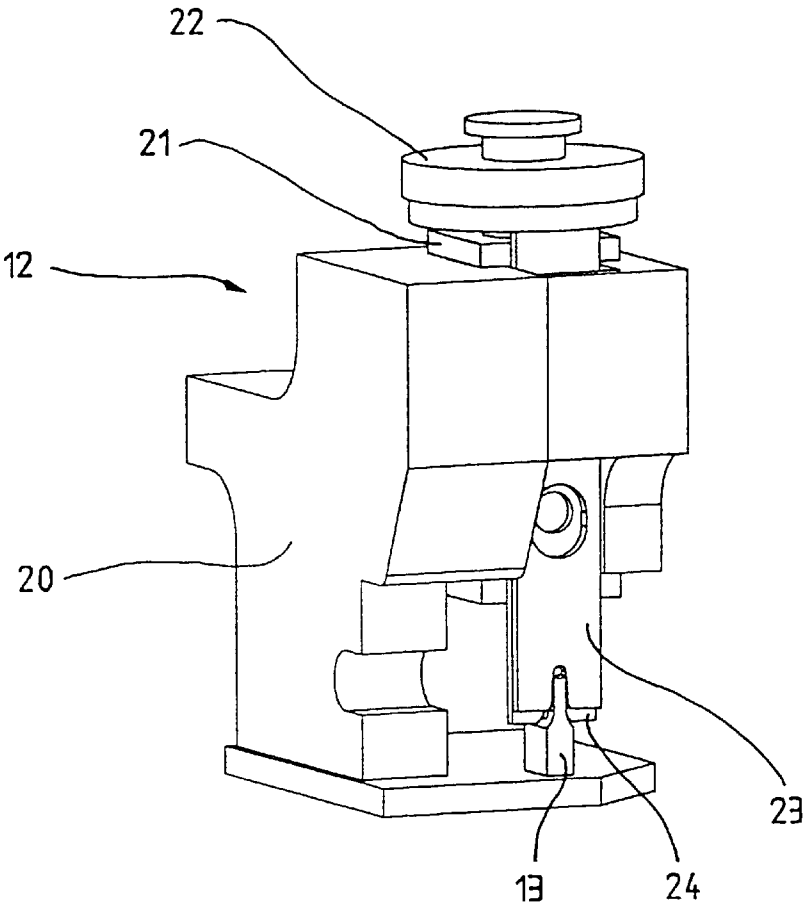
FIG. 2 shows the tool with crimping dies in the lower dead center position.

FIGS. 2 and 3 show details of the tool 12 for production of a crimp connection. A die carrier 21 is guided in a tool housing 20 and comprises a carrier head 22, which stands in loose connection with the retaining fork 11 of the tool holder 10. A first crimping die 23 and a second crimping die 24, which together with the correspondingly constructed anvil 13 produce the crimp connections, are arranged at the die carrier 21. FIG. 2 shows the crimping dies 23, 24 in the lower dead center position of the eccentric pin 7, in which the production of the crimp connection is concluded. FIG. 3 shows the crimping dies 23, 24 in the upper dead center position of the eccentric pin 7. The die stroke is determined by the two dead center positions.

Figure 4:
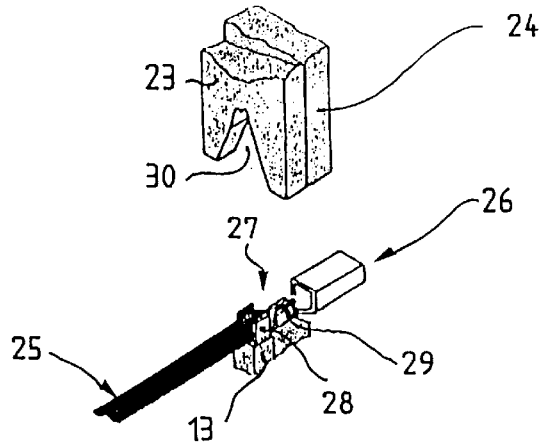
FIGS. 4, 5, 6 show the steps of a crimping process for simultaneous production of an insulation crimp and a wire crimp.
Figure 5:
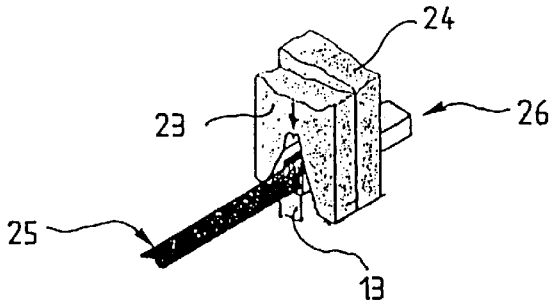
Figure 6:
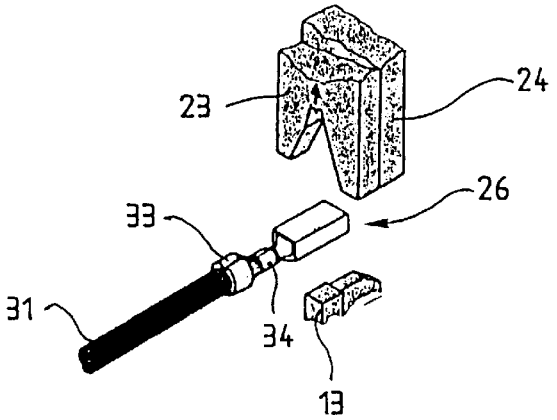
Figure 7:
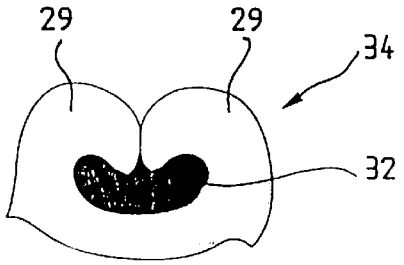
FIG. 7 shows details of a wire crimp.

FIGS. 4 to 6 show the crimping process, in which the end of a conductor 25 is connected with a contact 26. An open crimp zone 27 of the contact 26 has a first double tongue 28 for the insulation crimp and a second double tongue 29 for the wire crimp. FIG. 4 shows the crimping dies 23, 24 in the upper dead center position. The end of the conductor insulation lies in the first double tongue 28 and the stripped conductor piece lies in the second double tongue 29. As shown in FIG. 5, upon lowering of the crimping dies 23, 24 the double tongues 28, 29 are pressed together by means of wedge-shaped recesses 30 of the crimping dies 23, 24. A dome-shaped upper end of the recess 30 gives the final form to the double tongue 28 or 29 together with the conductor insulation or the conductor wire. FIG. 6 shows the finished crimp connection with an insulation crimp 33, in which the first double tongue 28 is pressed around the conductor insulation 31, and with a wire crimp 34, in which the second double tongue 29 is pressed around the conductor wire 32. FIG. 7 shows how in the wire crimp 34 the second double tongues 29 are squashed together with the conductor wire 32, which is constructed as a strand.

Figure 8:
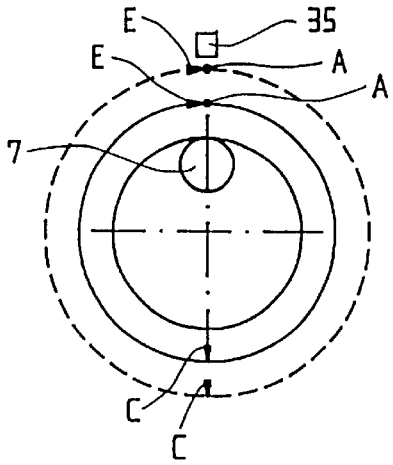
FIG. 8 shows a rotation diagram of the crimping press with constant rotation and maximum stroke for contacts with an open crimp zone.
Figure 9:
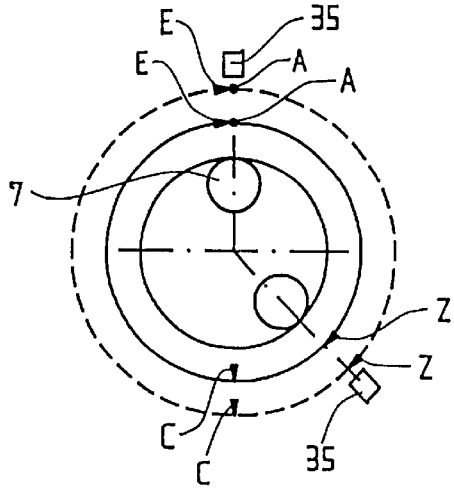
FIG. 9 shows a rotation diagram of the crimping press with constant rotation, maximum stroke and intermediate position for contact centering for contacts with a closed crimp zone.
Figure 10:
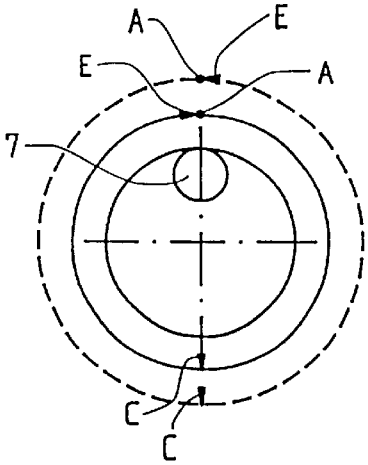
FIG. 10 shows a rotation diagram of the crimping press with alternating rotation and maximum stroke for contacts with an open crimp zone.
Figure 11:
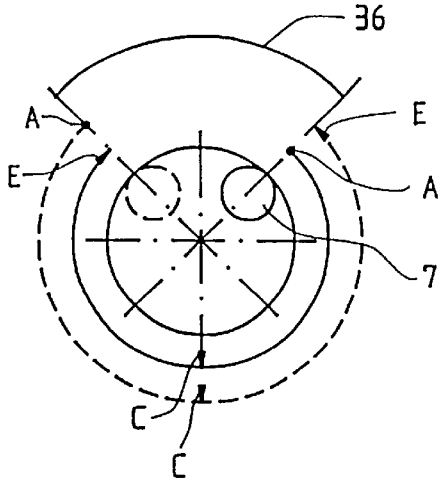
FIG. 11 shows a rotation diagram of the crimping press with alternating rotation and smaller stroke for contacts with an open crimp zone.
Figure 12:
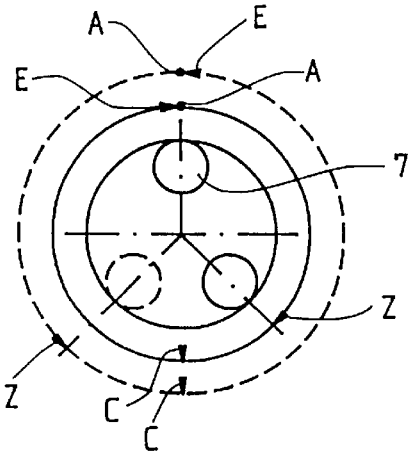
FIG. 12 shows a rotation diagram of the crimping press with alternating rotation, maximum stroke and intermediate position for contact centering for contacts with a closed crimp zone.
Figure 13:
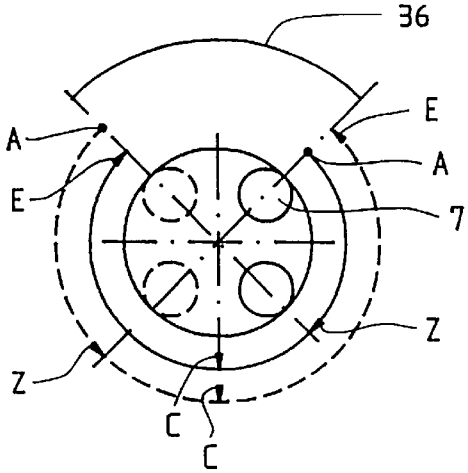
FIG. 13 shows a rotation diagram of the crimping press with alternating rotation, smaller stroke and intermediate position for contact centering for contacts with a closed crimp zone.

FIGS. 8 to 13 show the rotation diagram of the eccentric pin 7. The rotational movement of the eccentric pin 7 during the straight crimping processes is illustrated by solid line. The rotational movement of the eccentric pin 7 during the non-straight crimping processes is illustrated by dashed line. FIGS. 8 and 9 show the prior art, in which the eccentric pin 7 rotates in the same direction with maximum stroke in each crimping process. Start and end position A, E, as well as intermediate position Z are picked up by means sensors 35, usually proximity switches, detecting the eccentric pin 7 and the crimping press is controlled by the corresponding signals. Start and end position A, E as well as intermediate position Z are preset by the geometric arrangement of the sensors 35 and can be changed only by changing the sensor arrangement.

The rotation diagrams of FIGS. 10 to 13 show the control of the crimping press according to the invention. In, for example, the straight crimping processes the eccentric pin 7 rotates in one direction and in the non-straight crimping processes the eccentric pin 7 rotates in an opposite direction. No sensors are provided for detection of the start and end position A, E, or the intermediate position Z and the crimping position C. The detection of every position of the eccentric pin 7 is effected by means of the resolver 37 driven by the shaft 6. The construction and mode of function of the resolver 37 are more closely explained below in connection with FIGS. 14 and 15. According to FIGS. 11 and 13 a crimp connection can also be produced with a smaller stroke than the maximum stroke. The control 16 recognizes at any time the position of the eccentric pin 7 and can, by corresponding motor commands, shorten the stroke and thus the crimping process by the path denoted by 36. Start and end position A, E of the eccentric pin 7 are no longer at the same place in a crimping process. No mechanical action, for example an exchange of the shaft, is necessary for changing the stroke length.

Figure 14:
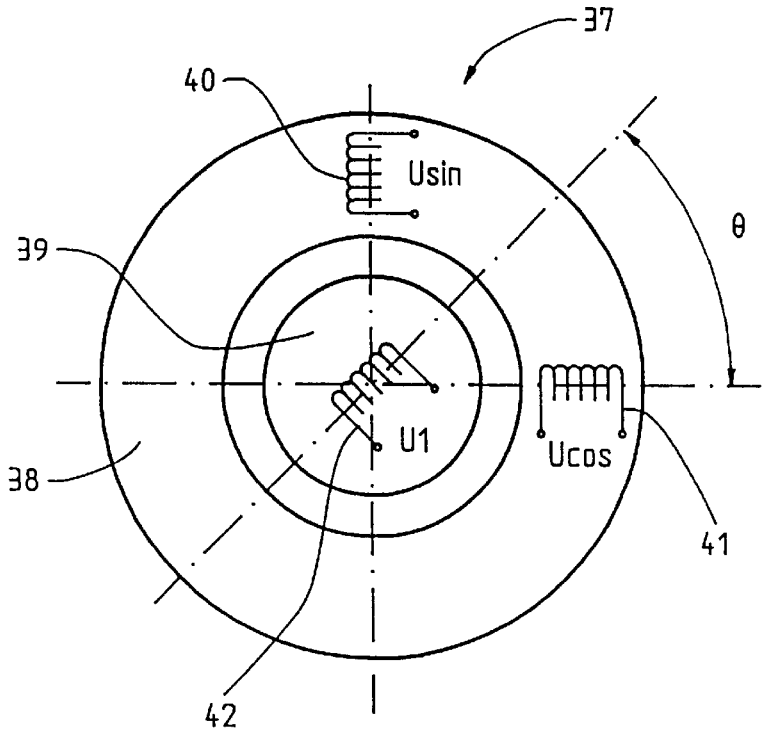
FIG. 14 shows the construction, in terms of principle, for a resolver for measuring angular positions.
Figure 15:
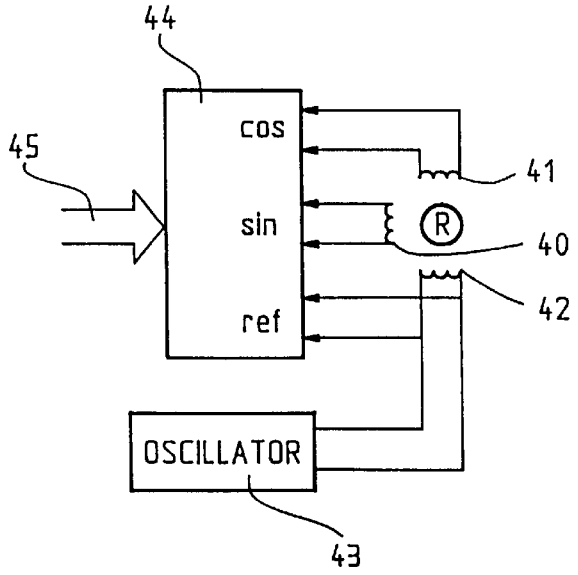
FIG. 15 shows a resolver interface.

FIGS. 14 and 15 show the construction, in terms of principle, and the mode of function of the resolver 37, which delivers an absolute signal per revolution and is insensitive with respect to vibrational loading and temperature. By virtue of this mechanical construction its angle information is maintained even in the case of loss of voltage. The resolver consists of a stator 38 and a rotor 39, which is driven by the shaft 6, and serves for the measurement of angular positions. A first stator winding 40 and a second stator winding 41 are arranged at the stator 38 and a rotor winding 42 is arranged at the rotor 39. The rotor winding 42 is excited by an alternating voltage U1 with constant amplitude and frequency, for example 5000 Hz. The second stator winding 41 is arranged displaced relative to the first stator winding 40 through 90 degrees. The voltage U1 respectively generates the two voltages Usin and Ucos at the terminals of the stator windings 40, 41 through electromagnetic coupling. These two voltages have the same frequency as U1. However, the amplitude is proportional to the sine and cosine of the mechanical angle θ. The energizing of the rotor winding 42 is effected by way of an oscillator 43. In the case of a resolver with a pole pair, the amplitude of the two voltages Usin and Ucos in each case runs through a sine oscillation per mechanical revolution. A resolver interface 44 evaluates the sine signal and the cosine signal of the resolver 37 with, for example, a resolution of 0.35 degrees and converts the angle θ into a digital value. The resolver interface 44 is connected at the output to a bus system 45 of the control 16.

Figure 16:
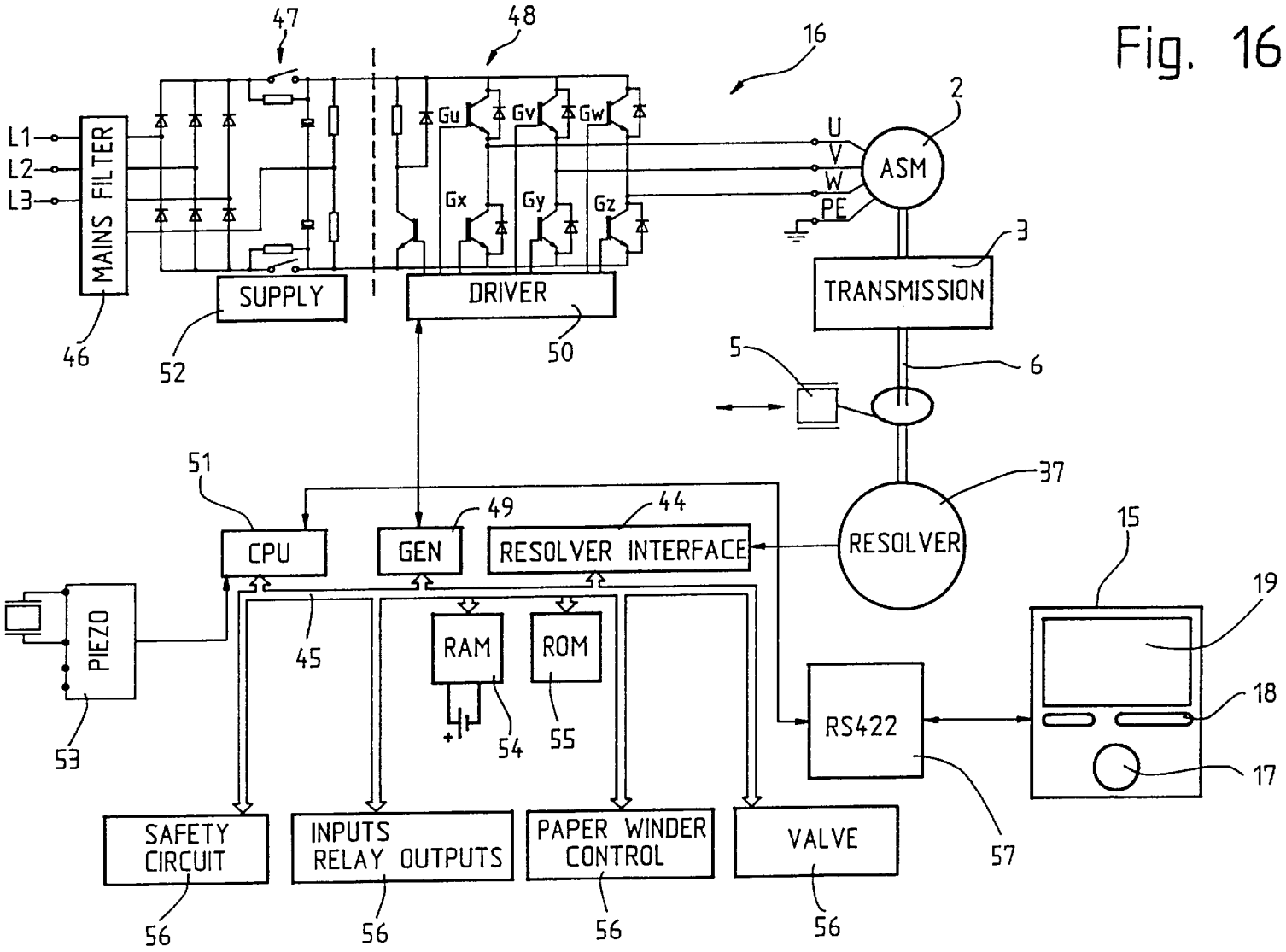
FIG. 16 shows a schematic of a press control.

FIG. 16 shows details of the control 16 for the crimping press. A converter 47 equipped at the output with a power line filter 46 converts the power supply voltage into a direct voltage, by which an inverter 48 is energized. Controlled semiconductor switches Gu . . . Gz of the inverter 48 chop the direct voltage, in a pulse-width modulation process, into three rectangular alternating voltages, which generate sinusoidal currents of variable frequency in the motor 2. The rotational movement is transmitted by the motor 2 to the transmission 3 and then to the shaft 6, at one end of which is arranged the eccentric pin 7 and at the other end of which is arranged the resolver 37. The eccentric pin 7 displaces the crimping bar 5 into a linear movement. A pulse generator 49 reduces the pulse pattern which is necessary for the drive control of the semiconductor switches Gu . . . Gz and which is supplied to a drive stage 50, which is connected at the output with the control lines of the semiconductor switches Gu . . . Gz. A processor 51 controls all functions of the crimping press. The bus system 45 is available for data exchange between the processor and the peripheral blocks. A power supply 52 generates the auxiliary voltages necessary for operation of the control 16. A quartz-controlled pulse generator 53 generates the clock frequency for the processor 51. A battery-supported read-write memory 54 serves as a working memory for the processor 51. The program for control of the crimping press is filed in a read only memory 55. Other machines participating in the crimping process, such as, for example, a conductor feeder or a contact feeder, control devices, safety circuits, etc., are designated by the reference symbol 56 and communicate with the control 16, for example for synchronization, via the bus system 45. The operator terminal 15 is connected with the processor 51 by means of a serial interface 57. Menu-directed, user-specific data, such as password, language, units, etc., and operation-specific data, such as acceleration, deceleration, frequency of the motor and position point along the stroke for synchronization of the peripheral machines and devices 6 participating in the crimping process, can be input at the operator terminal 15. Moreover, system items of information, service-relevant data, statistical evaluations, protocol data of the communication, drive data, etc, can be accessed via operator terminal 15. Modes of operation, such as calibration of the start position of the crimping bar 5, set-up operation for prescription of the stroke necessary for the respective tool, triggering of a single crimping process for checking of the crimp connection, crimping process with intermediate stop for positioning of the contact and subsequent pressing of the contact, crimping process with preselected stroke, etc., can also be prescribed in a menu-directed manner via operator terminal 15 for the control 16, whereby the crimping bar 5 and thus the tool 12 are positionable by means of the rotary knob 17.

The principle of the selectable stroke can also be used at, for example, crimping presses in which the linear movement of the crimping tool is produced directly by means of linear drives. A linear transmitter, which detects the tool position along the stroke path, is used instead of the resolver.

The invention is not limited by the embodiments described above which are presented as examples only but can be modified in various ways within the scope of protection defined by the appended patent claims.

We claim:

1. A method of controlling a crimping process which serves for connecting a contact with a conductor, said process comprising driving a crimping tool through a linear tool stroke by rotating an eccentric pin from a start position to an end position, said crimping tool having a start position corresponding to said start position of said eccentric pin, an end position corresponding to said end position of said eccentric pin, and a crimping position between said start position and said end position of said crimping tool, and varying the start position and the end position of the eccentric pin in order to change the length of the tool stroke between said start position and said crimping position of said crimping tool, and between said crimping position and said end position of crimping tool.

2. A method as in claim 1 wherein said driving said crimping tool comprises rotating said eccentric pin in a single direction from said start position to said end position of said eccentric pin.

3. A method as in claim 2 further comprising rotating said eccentric pin in an opposite direction, from said end position to said start position of said eccentric pin, in a succeeding stroke of said crimping tool.

4. A method as in claim 1 further comprising detecting a position of said crimping tool and using the detected position to control the crimping.

5. A method as in claim 1 further comprising the step of selecting a crimping process from the group consisting of a crimping process for checking a crimp connection, a crimping process with an intermediate stop for positioning the conductor, and a crimping process with a preselected stroke.

6. An apparatus for producing a crimp connection between a contact and a conductor, said apparatus comprising a crimping tool which is driven through a tool stroke by rotating an eccentric pin from a start position to an end position, said crimping tool having a start position corresponding to said start position of said eccentric pin, an end position corresponding to said end position of said eccentric pin, and a crimping position between said start position and said end position of said crimping tool, and control means for selectively controlling position and movement of the crimping tool, said control means including means for varying the start position and the end position of the eccentric pin in order to change the length of the tool stroke between at least one of said start position and end position of said crimping tool, and said crimping position of said crimping tool.

7. An apparatus as in claim 6 further comprising a drive motor for rotating said eccentric pin, said control means comprising a computer operatively connected to the drive motor for controlling the drive motor according to selectable prescribing data in dependence on a respective position of the crimping tool.

8. An apparatus as in claim as in claim 7 wherein said control means further comprises a transmitter for detecting the respective position of the crimping tool.

9. An apparatus as in claim 7 wherein said control means comprises an inverter operatively connected between the computer and the drive motor for controlling the motor in accordance with specification data from the computer.

10. An apparatus as in claim 6 further comprising an operator input terminal in operative communication with the control means, a keyboard for input of user data, a display unit for visualization of system data, and a rotary knob for selecting the start position and the end position of the crimping tool.

11. An apparatus as in claim 6 wherein said eccentric pin is driven in a single direction from said start position to said end position of said eccentric pin.

* * * * *